United States Patent [19]

Anderson et al.

[11] 4,010,301

[45] Mar. 1, 1977

[54] CARPET TILE

[75] Inventors: Ray C. Anderson; Joseph H. Kyle, both of LaGrange, Ga.

[73] Assignee: Carpets International-Georgia (Sales), Inc., LaGrange, Ga.

[22] Filed: Apr. 9, 1976

[21] Appl. No.: 675,341

Related U.S. Application Data

[63] Continuation-in-part of Ser. No. 524,813, Nov. 18, 1974, abandoned.

[52] U.S. Cl. ..... 428/95; 428/82

[51] Int. Cl.² ..... D03D 27/00; D04H 11/00; D05C 17/00

[58] Field of Search ..... 428/82, 88, 90, 95

[56] References Cited

UNITED STATES PATENTS

| | | | |
|---|---|---|---|
| 3,014,829 | 12/1961 | Curtin | 428/82 |
| 3,120,083 | 2/1964 | Dahlberg | 428/95 |

*Primary Examiner*—Marion E. McCamish
*Attorney, Agent, or Firm*—Burns, Doane, Swecker & Mathis

[57] ABSTRACT

An improved carpet tile for commercial, industrial or home use is disclosed. The carpet tile includes a carpet pile yarn facing portion including a stiffening and stabilizing layer (e.g., glass fiber layer). The backing portion also includes a stiffening and stabilizing layer (e.g., glass fiber layer). Interposed between the facing and backing portions is a stabilizing layer of a mixture of from about 70 to about 90 weight percent non-woven glass fibers and from about 30 to about 10 weight percent of a polyester. The resulting unitary carpet tile shows surprising dimensional stability, stiffness and floor hugging properties even during periods of concentrated stress, and passes rigorous flame retardancy and smoke emission tests.

20 Claims, 1 Drawing Figure

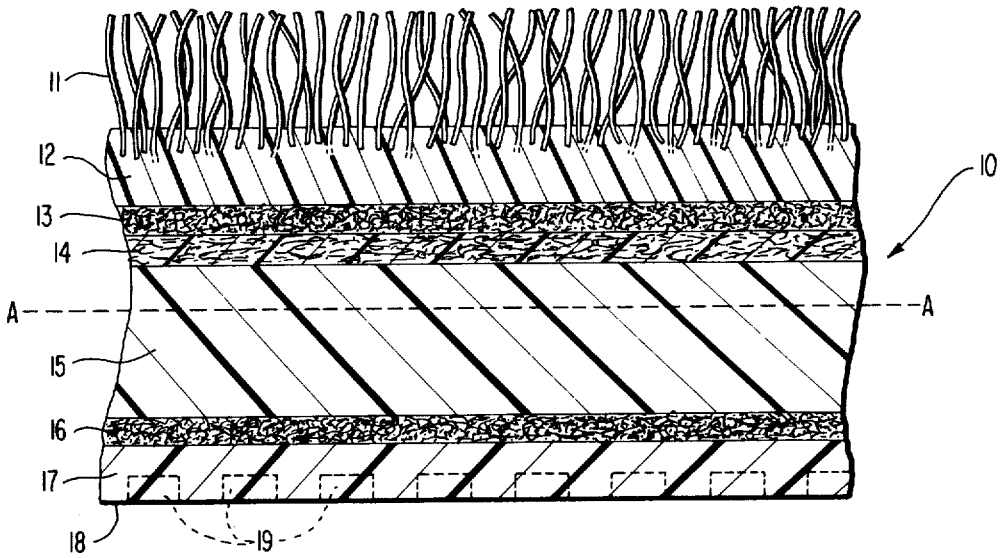
11
12
13
14
A
A
15
16
17
18
19
10

CARPET TILE

CROSS-REFERENCE TO RELATED APPLICATION

This application is a continuation-in-part of our copending U.S. patent application Ser. No. 524,813, filed Nov. 18, 1974 now abandoned.

BACKGROUND OF THE INVENTION

In recent years there has been considerable interest in carpet tiles. Carpet tiles offer considerable advantages over rugs or wall to wall carpeting which has heretofore been used extensively. For example, the use of carpet tiles for floor covering allows removal of individual tiles which have become worn or soiled more than other tiles. Those tiles which are not worn or soiled may be left in place. Additionally, tiles may be rearranged or replaced to enhance decorative effects.

Carpet tile and carpet construction are, of course, well-known in the art and are shown, for example, in U.S. Pat. Nos. 3,402,094; 3,347,735; 3,764,448; 3,238,595; 2,776,233; 3,173,823; 3,309,259; 3,320,113; 3,515,622; 3,642,516; 3,120,083; and 3,014,829. In addition, carpet tiles of various constructions have been available commercially.

Generally, carpet tiles as known heretofore have included a pile fabric facing set in a layer of resilient thermoplastic (including elastomeric) material which is stiffened with a layer of suitable stiffening fibers such as of glass, polypropylene, nylon or the like. The tile is generally backed with another layer of resilient elastomeric or thermoplastic material to which an adhesive may be applied to set the carpet tile onto the floor. Commercially available carpet tiles are available with an adhesive applied on the backing and a strippable protective layer attached thereto. In use, the protective layer is stripped off and the carpet tile applied to the floor surface. While the known carpet tile constructions offer many advantages over conventional rugs, wall to wall carpeting or the like, many problems remain.

Dimensional stability is important in a carpet tile. Dimensional stability, as understood in the art, is the ability of a carpet tile to lie flat and remain flat and square on a floor surface under conditions of normal use. To achieve commercially acceptable dimensional stability, particularly dimensional stability under concentrated stress (as when a wheeled object such as a desk chair, couch, typewriter stand or the like, traverses a floor composed of a plurality of carpet tiles), it has generally heretofore been necessary to adhere the carpet tiles to the floor with a suitable adhesive. The use of an adhesive, however, diminishes the advantageous features of carpet tiles as compared with rugs or wall to wall carpeting. An adhesive-installed tile requires substantial time and effort to remove or replace an individual tile. When the carpet tile is backed with an adhesive layer, it is often difficult to precisely align the carpet tile since the tile sticks to the floor surface as soon as it is placed in contact therewith.

Tiles which are not adhesively adhered to the floor (known as free-lay tiles) have heretofore been too dimensionally unstable, particularly when subjected to concentrated stress, to be commercially practical. It has been proposed to prestress the carpet tiles during manufacture to overcome the dimensional stability problem. A pre-stressed carpet tile of this type can be manufactured, for example, with a dome-type of orientation in which the center of the tile is slightly higher than all of the corners. This construction is purported to reduce dimensional instability, particularly under concentrated stress. It has been found, however, that carpet tiles of this type do not lie flat and tend to form exaggerated domes in use. This different type of dimensional instability also makes this type of carpet tile commercially unsatisfactory.

Another important consideration is the flame retardant and smoke emission characteristics of the carpet tile. Commercially available carpet tile products are subjected to the stringent flame retardant and smoke characteristics requirements set forth in ASTM E-84. It has been suggested to utilize a glass fabric material both for the backing and for the pile surface in order to meet these rigid requirements. See, for example, U.S. Pat. No. 3,764,448. While an all glass fabric may satisfy these flame and smoke requirements, glass fibers are often irritating to humans and thus not particularly suitable for use in such a situation in which the fiberglass fiber would be expected to come in contact with human skin. In addition, glass filaments are known to be relatively stiff, brittle and self abrasive. Their use makes processing and formation of carpet material more difficult. Carpet and/or carpet tile manufacturers thus tend to minimize the use of glass fibers as much as possible.

OBJECTS AND SUMMARY OF THE INVENTION

It is an object of this invention to avoid or alleviate the problems of prior art.

It is a further object of this invention to provide a carpet tile which has high flame retardance and low smoke emission properties.

It is also an object of this invention to provide a carpet tile which meets the strict requirements of ASTM E-84 for flame retardance and smoke emission.

It is also an object of this invention to provide a carpet tile which is dimensionally stable and which resists puckering under loads of concentrated stress such as found in commercial or home use.

It is further an object of this invention to provide a carpet tile which offers an improved balance of floor hugging, dimensional stability, flame retardance and smoke emission properties.

It is also an object of this invention to provide a carpet tile which is relatively supple, comfortable and nonirritating to human skin.

In one aspect the present invention provides a carpet tile comprising:

- a facing portion including carpet pile projecting from said facing and a layer of resilient thermoplastic material;
- a first stiffening and stabilizing portion of glass fibers;
- an intermediate stabilizing layer consisting essentially of from about 70 to about 90 weight percent nonwoven glass fibers and concomitantly, from about 30 to about 10 weight percent of a polyester;
- a resilient backing portion including a second stiffening and stabilizing portion of glass fibers and a layer of resilient thermoplastic; and
- said carpet tile including a layer of resilient thermoplastic material between said stiffening and stabilizing portions of glass fibers, said stiffening and stabilizing portions of glass fibers providing substantial heat shielding effects to the carpet tile.

In another aspect there is provided a carpet tile section comprising in interposed, bonded relationship:

a. a carpet facing layer of pile projections incorporated in a layer of first resilient thermoplastic material;

b. a first glass fiber stiffening and stabilizing layer;

c. a dimensional stabilizing layer consisting essentially of from about 70 to about 90 weight percent of glass fibers and concomitantly from about 30 to about 10 weight percent of a polyester;

d. a layer of a second resilient thermoplastic material;

e. a second glass fiber stiffening and stabilizing layer; and f. a backing layer whereby said glass fiber stiffening and stabilizing layers provide substantial heat shielding effects to the carpet tile.

In still another aspect of the invention, there is provided a carpet tile having a balance of dimensional stability, floor-hugging, flame retardance and low smoke emission properties comprising an upper portion having a pile surface, a layer of resilient thermoplastic material and including a first stiffening and stabilizing membrane disposed below the pile surface;

a backing portion bonded thereto and including a second stiffening and stabilizing membrane and a layer of resilient thermoplastic material;

the said second stiffening and stabilizing membrane being further below the horizontal bend axis of the carpet tile than the said first stiffening and stabilizing membrane is above the said horizontal bend axis whereby application of lateral force to the pile surface imparts a greater tendency for the tile to bend downward than bend upward, the said second stiffening and stabilizing membrane being located above the bottom of the said carpet tile so as to provide flame retardance and low smoke emission properties to the resulting carpet tile.

BRIEF DESCRIPTION OF THE DRAWING

The FIGURE illustrates a cross-sectional view of a carpet tile section of the present invention;

DETAILED DESCRIPTION OF THE INVENTION

Referring now to the FIGURE, there is shown a preferred embodiment of the carpet tile of the present invention. The carpet tile 10 includes generally a facing surface which includes a carpet pile 11 such as cotton, wool, or any suitable natural or synthetic fiber which is embedded or otherwise incorporated into a layer of a resilient thermoplastic (including elastomeric) material. The pile 11 is embedded in any convenient manner in the layer 12 which can be formed of any suitable resilient thermoplastic material. Such materials are well known in the art. Suitable thermoplastic materials include eleatomeric materials such as the natural or synthetic rubbers such as sponge or foam rubber, polychloroprene, acrylonitrile-butadiene copolymers, ethylene-propylene-diene rubbers, and the like. Other suitable thermoplastic materials include petroleum resins, vinyl polymers, polybutene resins, polyisobutene-butadiene resins and copolymers and mixtures thereof. A preferred resilient thermoplastic material is a vinyl polymer such as polyvinyl chloride, polyvinylidine chloride, polyvinyl acetate, polyvinyl acetal, polyvinyl butyral, copolymers of any of these vinyl polymers and mixtures thereof. Polyvinyl chloride is most preferred.

The layer 12 is backed by a layer 13 of glass scrim which can be woven or non-woven. This layer which is disposed below the pile surface imparts stiffening and dimensional stability to the facing portion.

Disposed beneath the glass scrim layer 13 is a layer 14 which is a mixture of a major amount, that is, from about 70 to about 90, preferably from about 75 to about 85, weight percent of non-woven glass fibers and concomitantly, from about 30 to about 10, preferably from about 25 to about 15, weight percent of a resilient polyester. Any suitable polyester material can be used. Preferred are the polyesters formed from the esterification reaction of unsaturated polybasic acids and polyhydric alcohols. These materials are generally well known in the art. Suitable polyesters include polyethylene terephthalate, polybutylene terephthalate, polycyclohexane-(1,4)-dimethylol terephthalate and the like. This layer 14 contributes significantly to the dimensional stability, stiffness, flame retardance and low smoke emission of the overall carpet tile. In addition, the relatively small amount of resilient polyester material in this layer provides a suppleness to the layer for ease in manufacturing.

Disposed beneath the layer 14 is a layer 15 of a resilient thermoplastic material which also imparts suppleness and flexibility to the carpet tile. This layer 15 may also be composed of any suitable synthetic thermoplastic material such as described above. Again, the vinyl polymers preferred for use in layer 12 are advantageously utilized in this layer.

Disposed beneath layer 15 is a layer 16 which is a layer of non-woven glass fibers. This layer 16 imparts significant dimensional stability and resistance to puckering to the carpet tile. That is, this stiffening layer 16 is disposed further below the bend axis of the composite carpet tile (which bend axis is indicated by dotted line A—A in the FIGURE) than the stiffening layers 13 and 14 are disposed above the bend axis. Thus, the moment arm from the bend axis A—A to the stiffening layer 16 is greater than the opposite moment arm from the bend axis A—A to the composite stiffening layer formed by the stiffening layers 13 and 14. The latter two stiffening layers 13 and 14 are disposed adjacent to each other (as described above) and tend to act together for stiffening purposes as a single unit or membrane. Due to this larger moment arm below the bend axis of the carpet tile, the application of a lateral force to the pile (or top) surface of the carpet tile imparts to the tile a greater tendency to bend downward than to bend upward. This improves the free-lay nature of the tile since the tendency of the tile to hug the floor overrides the tendency of the tile to turn upward under concentrated loads. In this manner, the resistance to rippling or dislodgement during movement of wheeled bodies across the carpet tile is substantially increased. It will be understood by those skilled in the art that the distances of the stiffening layers 13, 14 and 16 from the bend axis can be altered by altering the thickness of layers 12, 15 and 17 of resilient thermoplastic material. In all cases, however, the distance from the bend axis of layer 16 is greater than the corresponding distance for the composite layers 13 and 14 so as to provide the floor-hugging property as described above.

Beneath the fiberglass layer 16 is a conventional backing layer 17 which can be formed, for example, of a suitable thermoplastic material such as the various natural or synthetic rubbers, or various synthetic polymeric materials described above. The vinyl polymer preferred for use in layer 12 may also be advantageously utilized herein. In a preferred aspect of the invention, the layer 17 is provided on its bottom face 18 with a series of identations, corrugations, or the like to impart a friction increasing effect to the bottom of the tile to increase its resistance to movement in use and to increase its tendency to remain in position on the floor. Such friction-increasing indentations, indicated generally as 19 in the FIGURE, are well known per se in the art.

It will be understood that although the description of the carpet tile of the present invention has been given above in terms of "layers" that the carpet tile is a bonded unitary structure in which the individual layers are not easily discernible or removable from one another.

The carpet tile of the present invention can be constructed in any manner suitable to yield the desired materials in the proper orientation in a form in which the pile surface may be subsequently adhered. Suitable processes will be apparent to those skilled in the art. Advantageously, the composite bonded structure can be manufactured as an indeterminate length of material of about the width ultimately desired in the carpet tile or multiple thereof.

For example, a glass scrim layer can be disposed upon a preformed sheet containing a mixture of from about 70 to about 90, preferably from about 75 to about 85, weight percent of nonwoven glass fibers and concomitantly from about 30 to about 10, preferably from about 25 to about 15, weight percent of a polyester and a layer of a resilient thermoplastic material applied in a form in which the pile surface may be subsequently adhered (for example, in the form of a plastisol of polyvinyl chloride or the like). The pile surface can then be introduced into the plastisol layer in conventional fashion. For example, a tow of a plurality of continuous filaments can be cut, accumulated and pressed into the plastisol.

Another layer of resilient thermoplastic material may be coated on the underside (i.e., on the glass fiber-polyester layer) of the pile-faced composite in any convenient manner. Generally, the thermoplastic material is added as a relatively stiff plastisol which is heated to gel and partially fuse the plastisol coating. A non-woven glass fiber layer is then disposed on the thermoplastic layer. Advantageously, another layer of the plastisol of the thermoplastic material is first disposed on the non-woven glass fiber layer, the plastisol layers are each heated to gel and partially fuse and the non-woven glass fiber layer is adhered to the pile-faced composite by pressing the heated thermoplastic materials together. In this manner, the thermoplastic layer 15 of the FIGURE which is relatively thick (and which has concomitant relatively long gel times) can be formed by the consolidation of two thinner layers each of which takes a much shorter time to gel. Substantial process economies thus results.

The backing layer of thermoplastic material may then be applied (again conveniently in the form of a relatively stiff plastisol) which may be heated to gel and cure the thermoplastic material. While heated, the carpet tile precursor may then be passed under an embossing roller which embosses the back of the carpet with indentations, corrugations or the like to form a friction-increasing surface and assists in consolidating the layers into a unitary product. The consolidated carpet material may then be severed by suitable cutting means into appropriate length sections. For example, the carpet tile may be formed as an indeterminate length sheet of from 18 to 54 inches wide and then cut by suitable cutting means in the same length to thus form squares.

The resulting carpet tile product is suitable for use as a floor covering in home and/or commercial use where substantial flame retardance is desired and/or necessary and is particularly suitable for use in an office environment in which flame retardant characteristics are required and substantial high stress concentrations (e.g., wheeled traffic) is applied across the tiles. The tiles have a dense pile and do not require adhesives for installation. The individual modules may be replaced or rotated as necessary or desired. The carpet tiles also have dimensional stability with substantially no curling, slipping, buckling, stretching or shrinking. In addition, the carpet tiles have low smoke emission.

The invention is additionally illustrated in connection with the following Examples which are to be considered as illustrative of the present invention. It should be understood, however, that the invention is not limited to the specific details of the Examples.

EXAMPLE I

Nylon pile fabric material is cut from a plurality of continuous nylon filaments and pressed into a layer of polyvinyl chloride which had been applied as a tacky plastisol to a nonwoven glass scrim layer disposed on a layer which is a mixture of 80 weight percent glass fibers and 20 weight percent polyethylene terephthalate to form a carpet pile facing with the pile fabric material extending outwardly from the face of the layer. The material is 18 inches wide or multiples thereof and of continuous length.

A layer of polyvinyl chloride is applied to the underside of pile-faced materials as a relatively stiff plastisol. The coated material is leveled with a doctor blade which levels and smooths the polyvinyl chloride layer. The coated material is heated to 360° F. to gel and partially cure the polyvinyl chloride and contacted with a non-woven glass fiber layer which is also coated with a polyvinyl chloride layer which is also applied as a relatively stiff plastisol, leveled by a doctor blade, heated to 360° F. and advanced to the contact point.

The polyvinyl chloride layers of each coated material contact each other and are consolidated by passing between two rollers which apply a slight pressure to the material.

After consolidation, a backing layer of polyvinyl chloride is applied as a relatively stiff plastisol, leveled by a doctor blade, heated and embossed by an embossing roll to form indentations on the bottom. The embossed carpet material is cut into carpet tile squares.

Upon examination of a carpet tile square, it is determined that the lowest non-woven glass fiber layer in the composite carpet tile is disposed further below the horizontal bend axis of the carpet tile than the glass scrim layer and glass fiber-polyethylene layers are disposed above that bend axis.

EXAMPLE II

Samples of the carpet tiles of Example I are subjected to the flame retardance (or flame spread) and smoke emission tests of ASTM E-84. Generally, carpet tiles for use in commercial or industrial use have to show flame spread value of 75 or less and a smoke emission value of about 200 or less. The results obtained with the carpet tile samples of Example I are Flame Spread — 60; Smoke Emission — 195.

It may be seen that the carpet tiles of the present invention have substantial heat shielding effects.

A portion of an office floor surface is covered with the carpet tiles of Example I. The tiles are each applied to the floor surface without adhesive, that is, as free-lay tiles.

These carpet tiles are observed under varying conditions of typical office use. The carpet tiles of the present invention show no signs of dimensional instability even under concentrated stress e.g., when wheeled vehicles, chairs or the like, traverse the tiles, and do not require adhesive bonding to the floor.

It can thus be seen that the carpet tiles of the present invention offer an optimum balance of dimensional stability, floor hugging ability, flame retardance and low smoke emission properties. All of these properties are necessary for maximum commercial utilization.

This balance of dimensional stability, floor hugging ability, flame retardance and low smoke emission properties is achieved by the carpet tile construction of the present invention. When a carpet tile is formed utilizing a first stiffening and stabilizing membrane (or glass fibers and/or polyester and/or mixtures thereof) but without a second stiffening and stabilizing membrane, the resulting carpet tile is dimensionally unstable and has poor flame retardance and smoke emission properties. The inclusion of a second stiffening and stabilizing membrane of glass fibers in the backing portion generally improves the flame retardance and smoke emission properties but the resulting carpet tile is dimensionally unstable under concentrated stress and requires adhesive application to a floor unless the second stiffening and stabilizing membrane is disposed further below the horizontal bend (or neutral) axis of the the carpet tile than the first stiffening and stabilizing membrane is disposed above the horizontal bend axis. However, even if a second stiffening and stabilizing membrane is utilized, the second stiffening and stabilizing membrane should not be located so far below the horizontal (or neutral) bend axis so as to be essentially at the bottom of the carpet tile that the flame retardance and smoke emission properties are adversely affected in a test such as ASTM E-84.

It will be seen that the desired effect of this aspect of the present invention is to utilize the second stiffening and stabilizing membrane to isolate as much of the resilient thermoplastic material in the backing portion of the carpet tile from the direct impingement of the flame used in the ASTM E-84 test without disposing the membrane closer to the bend axis than the first stiffening and stabilizing membrane is disposed above that bend axis. Thus, a balance in these properties should be achieved. The use of a foam layer of the thermoplastic material as the intermediate layer between the first and second stiffening and stabilizing membranes adversely affects the flame retardance and smoke emission properties of the resulting carpet tiles in comparison with the use of a relatively stiff (non-foamed) layer of the thermoplastic material.

The principles, preferred embodiments and modes of the operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A carpet tile comprising a facing portion including carpet pile projecting from said facing and a layer of resilient thermoplastic material;

a first stiffening and stabilizing portion of glass fibers;

an intermediate stabilizing layer consisting essentially of from about 70 to about 90 weight percent non-woven glass fibers and concomitantly, from about 30 to about 10 weight percent of a polyester;

a resilient backing portion including a second stiffening and stabilizing portion of glass fibers and a layer of resilient thermoplastic material; and said carpet tile including a layer of resilient thermoplastic material between said stiffening and stabilizing portions of glass fibers, said stiffening and stabilizing portions of glass fibers providing substantial heat shielding effects to the carpet tile.

2. The carpet tile of claim 1 wherein said carpet pile fabric is imbedded in said layer of resilient thermoplastic material of said facing portion and projecting outwardly from one face thereof.

3. The carpet tile of claim 2 wherein said resilient backing portion includes a layer of resilient thermoplastic material having friction-increasing means on one face of said layer, the said second stiffening portion of glass fibers being adjacent to said layer of resilient thermoplastic material at an opposite face thereof and another layer of the resilient thermoplastic material adjacent to the said portion of glass fibers at the opposite face of the glass fiber portion.

4. The carpet tile of claim 3 wherein the resilient thermoplastic material of the facing portion and the resilient backing portion is the same.

5. The carpet tile of claim 4 wherein the resilient thermoplastic material is a vinyl polymer.

6. The carpet tile of claim 5 wherein said vinyl polymer is polyvinyl chloride.

7. The carpet tile of claim 6 wherein said intermediate stabilizing layer contains from about 75 to about 85 weight percent polyester and concomitantly from about 25 to about 15 weight percent glass fibers.

8. The carpet tile of claim 1 wherein each of said facing portion and backing portion includes a layer of vinyl polymer.

9. The carpet tile of claim 8 wherein each vinyl polymer is vinyl chloride.

10. A carpet tile section comprising in interposed, bonded relationship:

a. carpet facing layer of pile projections incorporated in a layer of a first resilient thermoplastic material;

b. a first glass fiber stiffening and stabilizing layer;

c. a dimensional stabilizing layer consisting essentially of from about 70 to about 90 weight percent of glass fibers and concomitantly from about 30 to about 10 weight percent of a polyester;

d. a layer of a second resilient thermoplastic material;

e. a second glass fiber stiffening and stabilizing layer; and f. a backing layer whereby said glass fiber stiffening and stabilizing layers provide substantial heat shielding effects to the carpet tile.

11. The carpet tile section of claim 10 wherein the backing layer is a third layer of a resilient thermoplastic material.

12. The carpet tile section of claim 11 wherein each said resilient thermoplastic material is a vinyl polymer.

13. The carpet tile section of claim 12 wherein each said vinyl polymer is polyvinyl chloride, copolymers or mixtures thereof.

14. A carpet tile having a balance of dimensional stability, floor-hugging, flame retardance and low smoke emission properties comprising an upper portion having a pile surface, a layer of resilient thermoplastic material and including a first stiffening and stabilizing membrane disposed below the pile surface;

a backing portion bonded thereto and including a second stiffening and stabilizing membrane and a layer of resilient thermoplastic material;

a layer of resilient thermoplastic material between the said first and second stiffening and stabilizing membranes;

the said second stiffening and stabilizing membrane being further below the horizontal bend axis of the carpet tile than the said first stiffening and stabilizing membrane is above the said horizontal bend axis whereby application of lateral force to the pile surface imparts a greater tendency for the tile to bend downward than bend upward, the said second stiffening and stabilizing membrane being located above the bottom of the said carpet tile to provide in conjunction with the first stiffening and stabilizing membrane flame retardance and low smoke emission properties to the resulting carpet tile.

15. The carpet tile of claim 14 wherein said first stiffening and stabilizing membrane includes a first layer of non-woven fibers and a second layer comprising a mixture of from about 70 to about 90 weight percent of non-woven glass fibers and, concomitantly, from about 30 to about 10, weight percent of a polyester.

16. The carpet tile of claim 15 wherein the thermoplastic material is a vinyl polymer.

17. The carpet tile of claim 14 wherein the backing portion includes friction-increasing means on the bottom thereof.

18. A free-laying carpet tile having dimensional stability and floor-hugging properties comprising an upper portion having a pile surface, a layer of resilient thermoplastic material and including a first stiffening and stabilizing membrane comprising glass fibers and a layer of resilient thermoplastic material;

a backing portion bonded thereto and including a second stiffening and stabilizing membrane comprising glass fibers and a layer of resilient thermoplastic material;

a layer of resilient thermoplastic material between the said first and second stiffening and stabilizing membranes;

the said second stiffening and stabilizing membrane being further below the horizontal bend axis of the carpet tile than the said first stiffening and stabilizing membrane is above the said horizontal bend axis whereby application of lateral force to the pile surface imparts a greater tendency for the tile to bend downward than bend upward, the said second stiffening and stabilizing membrane being located above the bottom of the said carpet tile to provide in conjunction with the first stiffening and stabilizing membrane flame retardance and low smoke emission properties to the resulting carpet tile.

19. A free-laying carpet tile having dimensional stability and floor-hugging properties comprising an upper portion having a pile surface, a layer of resilient thermoplastic material and including a first stiffening and stabilizing membrane comprising glass fibers and a polyester disposed below the pile surface;

a backing portion bonded thereto and including a second stiffening and stabilizing membrane comprising glass fibers and a layer of resilient thermoplastic material;

a layer of resilient thermoplastic material between the said first and second stiffening and stabilizing membrane;

the said second stiffening and stabilizing membrane being further below the horizontal bend axis of the carpet tile than the said first stiffening and stabilizing membrane is above the said horizontal bend axis whereby application of lateral force to the pile surface imparts a greater tendency for the tile to bend downward than bend upward, the said second stiffening and stabilizing membrane being located above the bottom of the said carpet tile to provide in conjunction with the first stiffening and stabilizing membrane flame retardance and low smoke emission properties to the resulting carpet tile.

20. A free-laying carpet tile having dimensional stability and floor-hugging properties comprising an upper portion having a pile surface, a layer of resilient thermoplastic material and including a first stiffening and stabilizing membrane comprising glass fibers and a polyester disposed below the pile surface;

a backing portion bonded thereto and including a second stiffening and stabilizing membrane comprising glass fibers and a layer of resilient thermoplastic material;

a layer of resilient thermoplastic material between the said first and second stiffening and stabilizing membrane;

the said second stiffening and stabilizing membrane being further below the horizontal bend axis of the carpet tile than the said first stiffening and stabilizing membrane is above the said horizontal bend axis whereby application of lateral force to the pile surface imparts a greater tendency for the tile to bend downward than bend upward.

* * * * *